US012427562B2

(12) United States Patent
Cantrell et al.

(10) Patent No.: US 12,427,562 B2
(45) **Date of Patent: *Sep. 30, 2025**

(54) DESCALING CELL COMPONENT AND METHOD

(71) Applicant: The Material Works, Ltd., Red Bud, IL (US)

(72) Inventors: Ryan Cantrell, Red Bud, IL (US); Alan Mueth, Red Bud, IL (US); Tim Voss, Red Bud, IL (US); Kevin Voges, Red Bud, IL (US)

(73) Assignee: The Material Works, Ltd., Red Bud, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/782,546

(22) Filed: Jul. 24, 2024

(65) Prior Publication Data

US 2024/0375166 A1 Nov. 14, 2024

Related U.S. Application Data

(62) Division of application No. 17/316,884, filed on May 11, 2021, now Pat. No. 12,121,948.

(51) Int. Cl.
*B21B 45/08* (2006.01)

(52) U.S. Cl.
CPC ..... *B21B 45/08* (2013.01)

(58) Field of Classification Search
CPC ..... B21B 45/08; B21C 43/00; B24C 3/14; B24C 7/0007; B24C 9/006; B24C 1/086
See application file for complete search history.

(56) References Cited

U.S. PATENT DOCUMENTS

| | | | |
|---|---|---|---|
| 4,269,052 | A | 5/1981 | Imai et al. |
| 4,768,314 | A | 9/1988 | Thomson |
| 7,601,226 | B2 | 10/2009 | Voges et al. |
| 8,062,095 | B2 | 11/2011 | Voges et al. |
| 8,066,549 | B2 | 11/2011 | Voges et al. |
| 8,074,331 | B2 | 12/2011 | Voges |
| 8,128,460 | B2 | 3/2012 | Voges et al. |
| 8,707,529 | B2 | 4/2014 | Voges |
| 2008/0108281 | A1 | 5/2008 | Voges et al. |
| 2011/0130075 | A1 | 6/2011 | Voges et al. |
| 2013/0084785 | A1 | 4/2013 | Cho et al. |
| 2019/0337036 | A1 | 11/2019 | Voges |

*Primary Examiner* — Moshe Wilensky
(74) *Attorney, Agent, or Firm* — Thompson Coburn LLP

(57) ABSTRACT

A method for descaling a sheet of metal include first and second descaling components that each have a only one motor driven slurry propelling impeller mounted on a top and bottom of an enclosure. The top and bottom mounted impellers of the first component are configured to propel slurry onto a sheet of metal passing through the enclosure across the entire width of the sheet of metal in a first direction extending from one lateral side to an opposite lateral side of the enclosure. The top and bottom mounted impellers of the second component are configured to propel slurry onto a sheet of metal passing through the enclosure across the entire width of the sheet of metal in a second direction opposite the first direction and extending from the opposite lateral side to the one lateral side of the enclosure.

9 Claims, 12 Drawing Sheets

DESCALING CELL COMPONENT AND METHOD

RELATED APPLICATION DATA

This application is a divisional of U.S. application Ser. No. 17/316,884, filed May 11, 2021, the disclosure of which is incorporated by reference herein.

BACKGROUND AND SUMMARY

The present disclosure is directed to a descaling cell component that improves upon the designs of descaling cells and their methods of use described in other patents owned by the applicant including U.S. Pat. Nos. 7,601,226, 8,062,095, 8,066,549, 8,074,331, and 8,128,460, the disclosures of which are incorporated by reference herein. As will become evident from the disclosure that follows, the descaling cell improves quality, lowers operating and maintenance costs, and provides a more standard platform for a descaling cell which is simpler in construction and lowers manufacturing costs.

DETAILED DESCRIPTION

Figure 1:
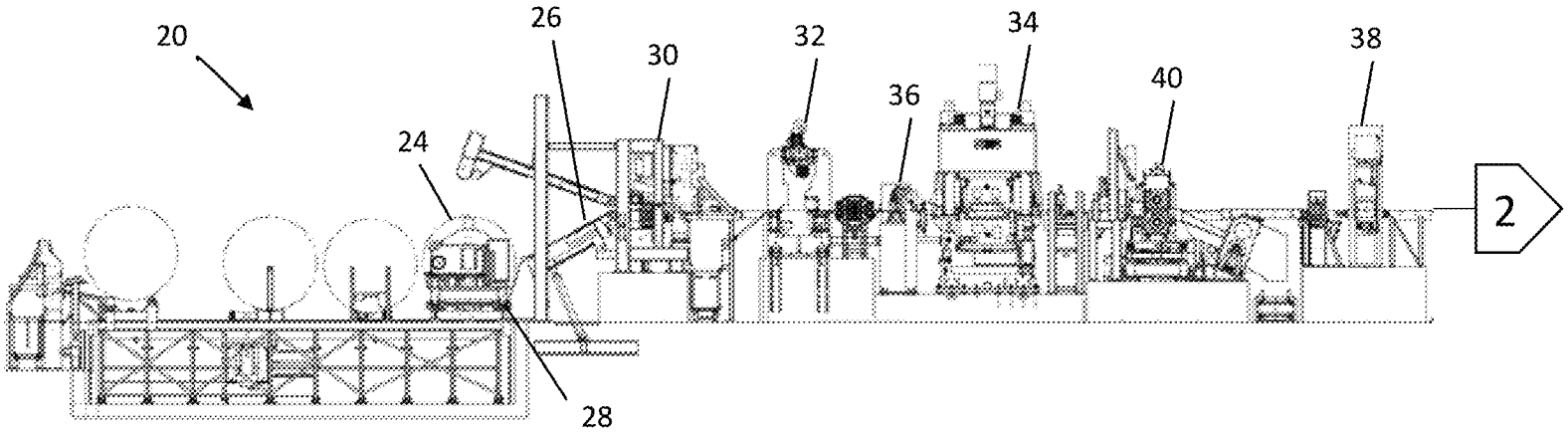
FIG. 1 is a partial view of a front end of a processing line using exemplary descaling components.
Figure 2:
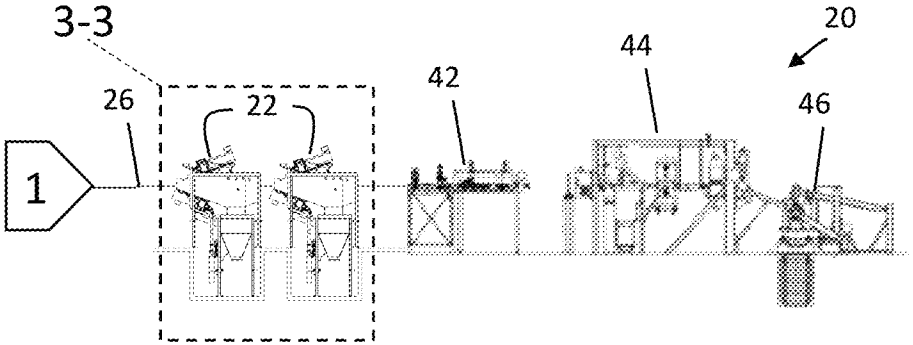
FIG. 2 is a partial view of a back end of a processing line using exemplary descaling components.

FIGS. 1 and 2 show an exemplary processing line 20 with FIG. 1 showing the front end of the processing line, and FIG. 2 showing the back end of the processing line with the descaling component 22 included in detail area 3-3 of FIG. 2. A coil 24 of previously processed sheet metal (for example hot rolled sheet metal) is positioned adjacent the processing line 20 for supplying a length of sheet metal 26 to the remainder of the processing line. The coil of sheet metal 24 may be supported on any conventional uncoiler 28 that functions to selectively uncoil the length of sheet metal 26 from the roll in a controlled manner. Alternatively, which is not shown in the drawings, the sheet metal could be supplied to the processing line as individual sheets. The free end of the sheet metal 26 from the uncoiler 28 may be directed to a crop shear machine 30 to shear the free end of the unpeeled coil such that it is perpendicular to the length edges of the strip thereby allowing the strip to be threaded through the line in an efficient manner. Then, the sheet metal 26 may be directed to a scale breaker 32 and a roller-leveler 34. Pinch rollers 36 may pull the sheet metal 26 through the scale breaker 32 and push the strip through the roller-leveler 34. Depending on the size material to be processed in the processing line, the line may be provided with stitching machinery 38 for connecting successive lengths of material together. For instance, if it is intended that the processing line process very thin gage strips of steel metal, the free ends of strips from successive coils may be stitched together with the stitching machine to enable the thin gaged materials to be pulled through the processing line. The thin gaged materials may excessively deflect when being pushed through the processing line and may require use of the tension reel to pull the material through the processing line. The stitcher may comprise a welding machine. The stitching machinery may also be omitted. In connection with the stitching machine 38, the line may be provided with an edge trimmer 40 to enable successive ends of the successive coils to be cleanly joined. To complete the descaling process, the processing line may be provided with the two descaling components 22 as described in further detail below. The scale removing media may include a slurry comprising a grit and liquid. The scale removing media may also comprise a grit. After the sheet metal 26 passes through the descaling components 22, the sheet metal may pass through a drying table 42, a crop shear machine 44, and through a take up reel 46. The take up reel may comprise a recoiler, for instance, a recoiler as described in U.S. Pat. No. 8,707,529, the disclosure of which is incorporated herein by reference.

As mentioned, the processing line includes a pair of descaling components 22 that are aligned in series to descale the top and bottom surfaces of the sheet metal 26. The pair of descaling components are sequentially arranged along the downstream direction of movement 48 of the sheet metal. Both of the descaling components are constructed in the same manner, with the exception that the single slurry propelling impeller wheel 50A,50B of one of the descaling components is arranged adjacent one lateral side of the sheet metal being processed (e.g., the operator side of the processing line), and the single slurry propelling impeller wheel of the other of the descaling components is arranged adjacent the opposite lateral side of the sheet metal being processed (e.g., the drive side of the processing line). The applicant has determined that two descaling components arranged in this manner provides efficiencies over the 8 slurry impeller wheels of the descaler cells described in its earlier patents, and that line speed, scale removal, and surface texture of the processed sheet metal is comparable to that of the 8 slurry impeller wheels of the descaler cells described in its earlier patents.

Figure 3:
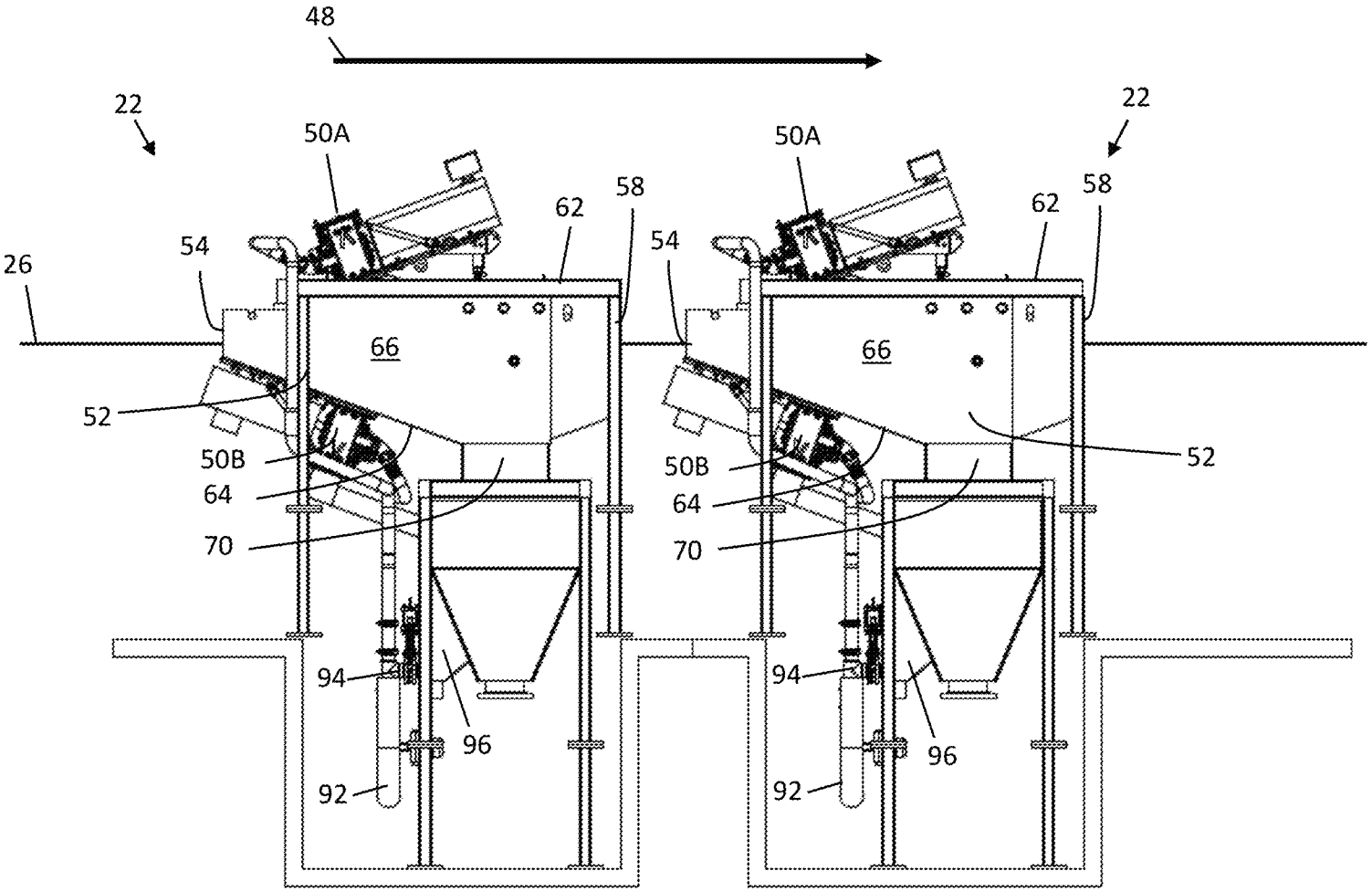
FIG. 3 is an enlarged view of detail area 3-3 of FIG. 2 showing exemplary descaling components of the processing line from a drive side of the processing line.
Figure 4:
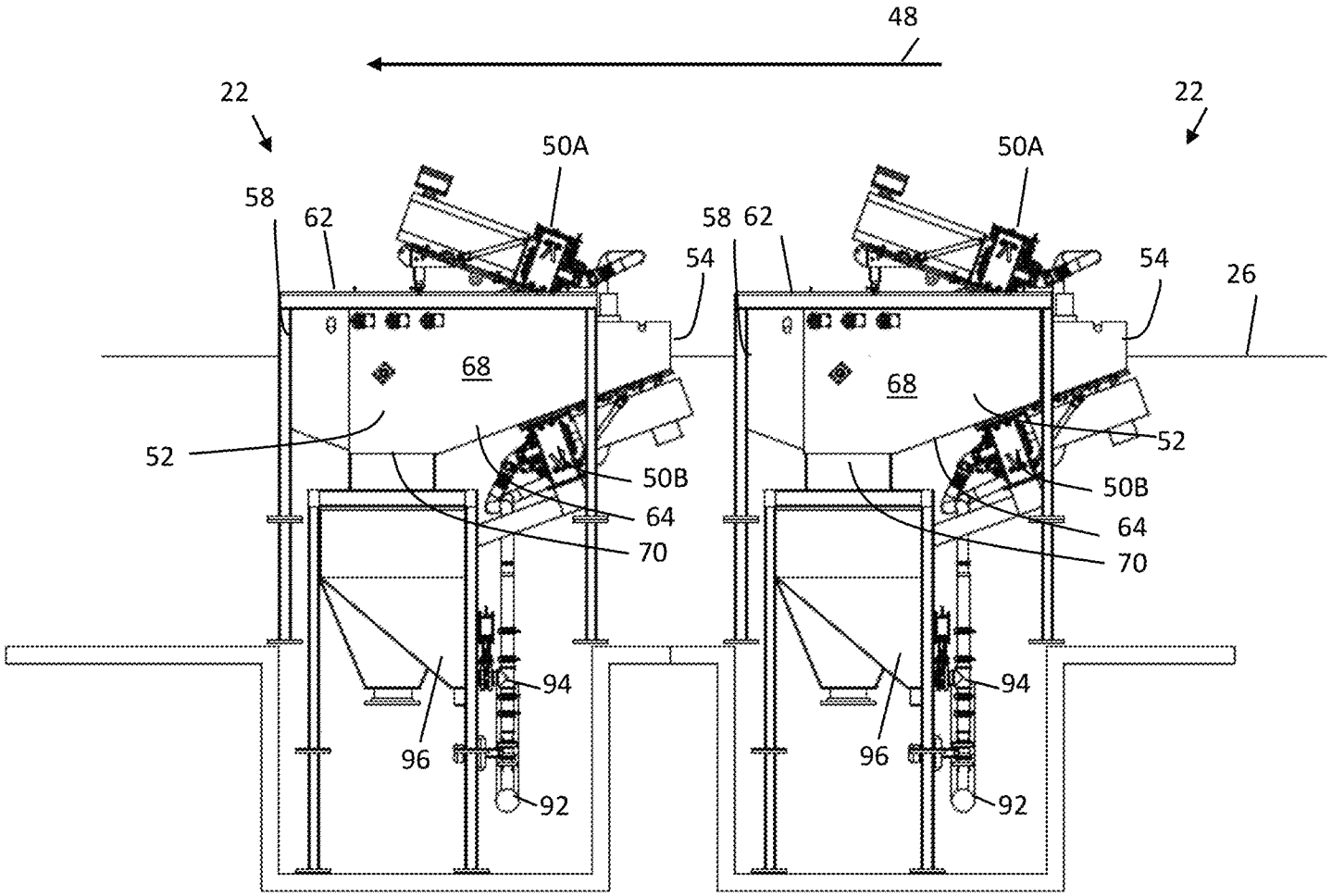
FIG. 4 shows the descaling components of FIG. 3 from a view opposite the view of FIG. 3 from opposite the drive side of the processing line.
Figure 5:
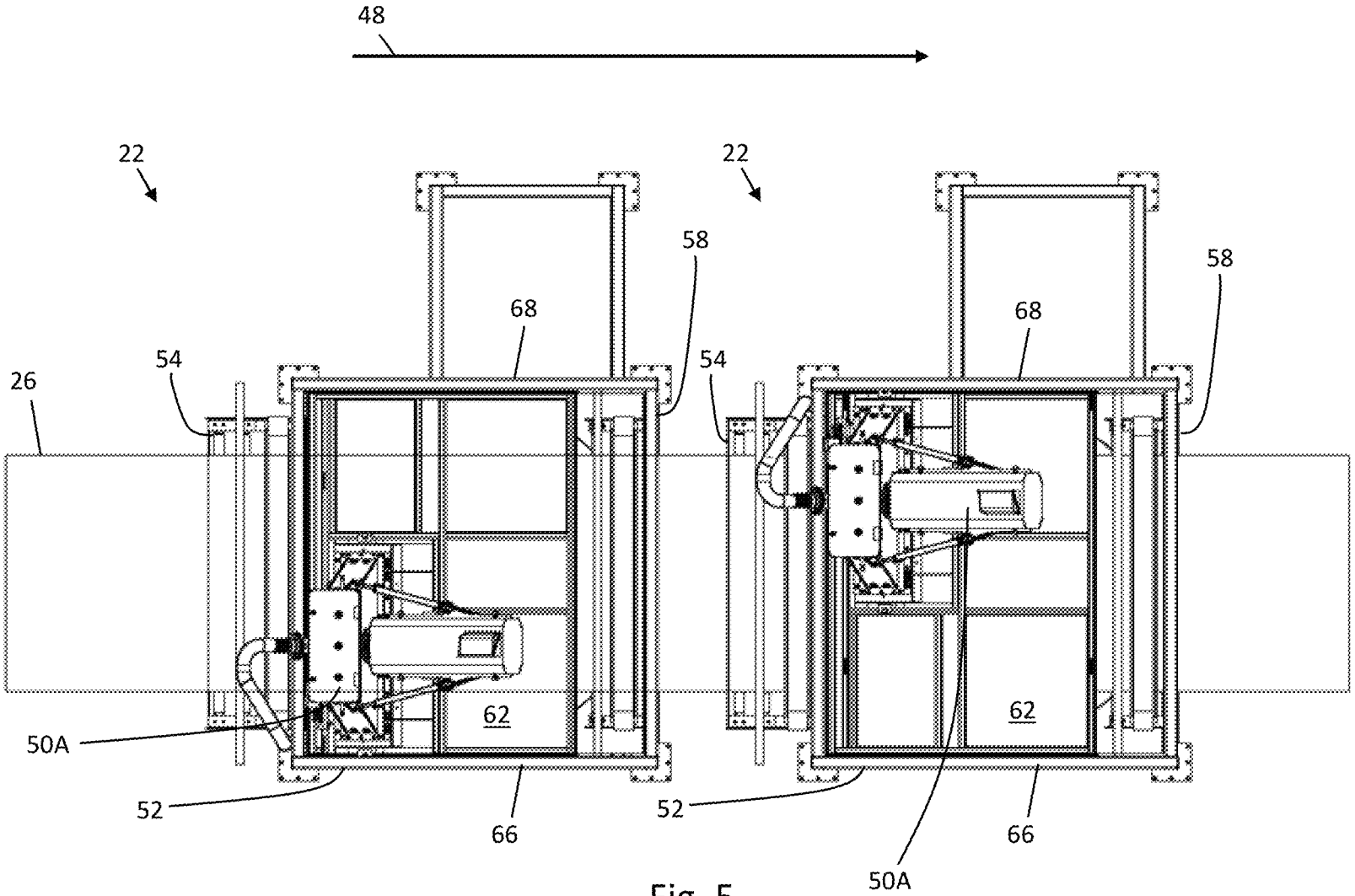
FIG. 5 is a top plan view of the descaling components of FIG. 3.

FIGS. 3 and 4 show enlarged side elevation views of the descaling components 22 removed from the processing line. In FIG. 3, the direction of travel 48 of the length of sheet metal is from left to right. The descaling component comprises a hollow enclosure 52. A portion of the length of sheet metal is shown passing through the descaling component enclosure. The length of sheet metal 26 is shown oriented in a generally horizontal orientation as it passes through the descaling component enclosure or box. It should be understood that the horizontal orientation of the sheet metal shown in the drawing figures is one way of advancing the sheet metal through the descaling cell, and the sheet metal may be oriented vertically, or at any other orientation as it passes through the descaling component apparatus. Therefore, terms such as "top" and "bottom," "above" and "below," and "upper" and "lower" should not be interpreted as limiting the orientation of the apparatus or the relative orientation of the length of sheet metal, but as illustrative and as referring to the orientation of the elements shown in the drawings.

Figure 6:
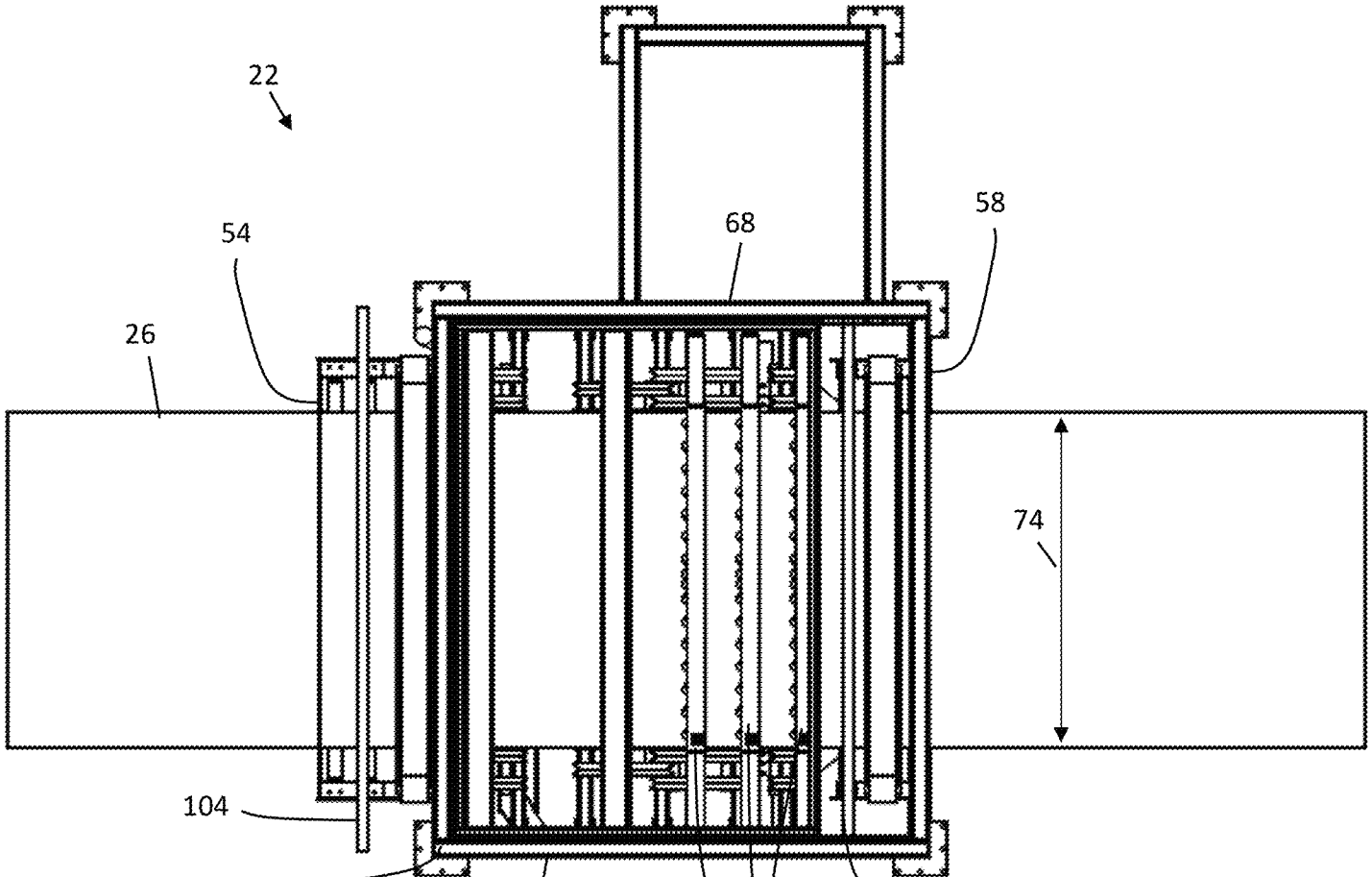
FIG. 6 is a top plan view of one of the descaling components of FIG. 3 with the top and top mounted impeller and motor removed to show a rinse station and an interior of an enclosure of the descaling component.
Figure 7:
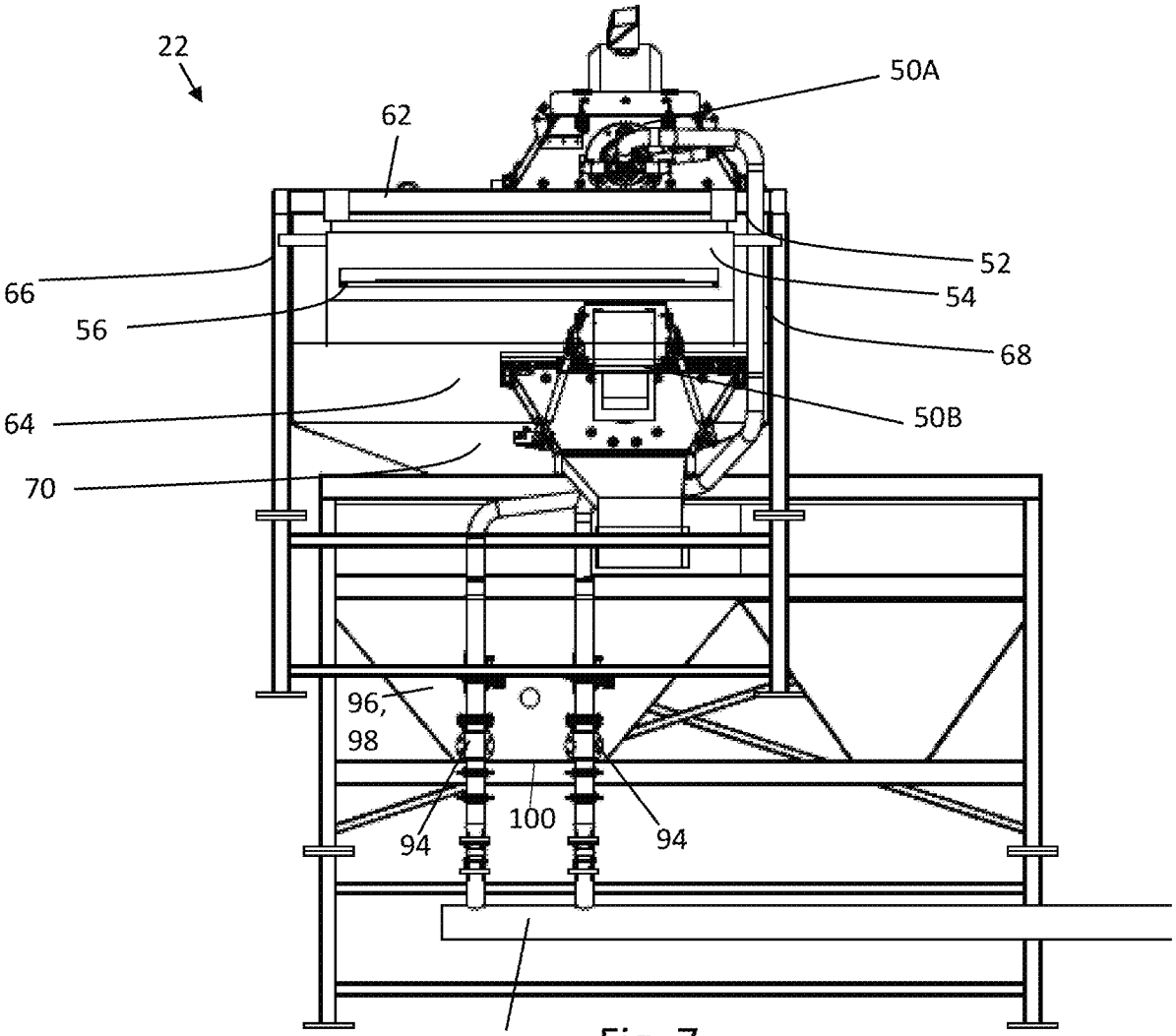
FIG. 7 is a front end view of a first in sequence descaling component of the processing line.
Figure 8:
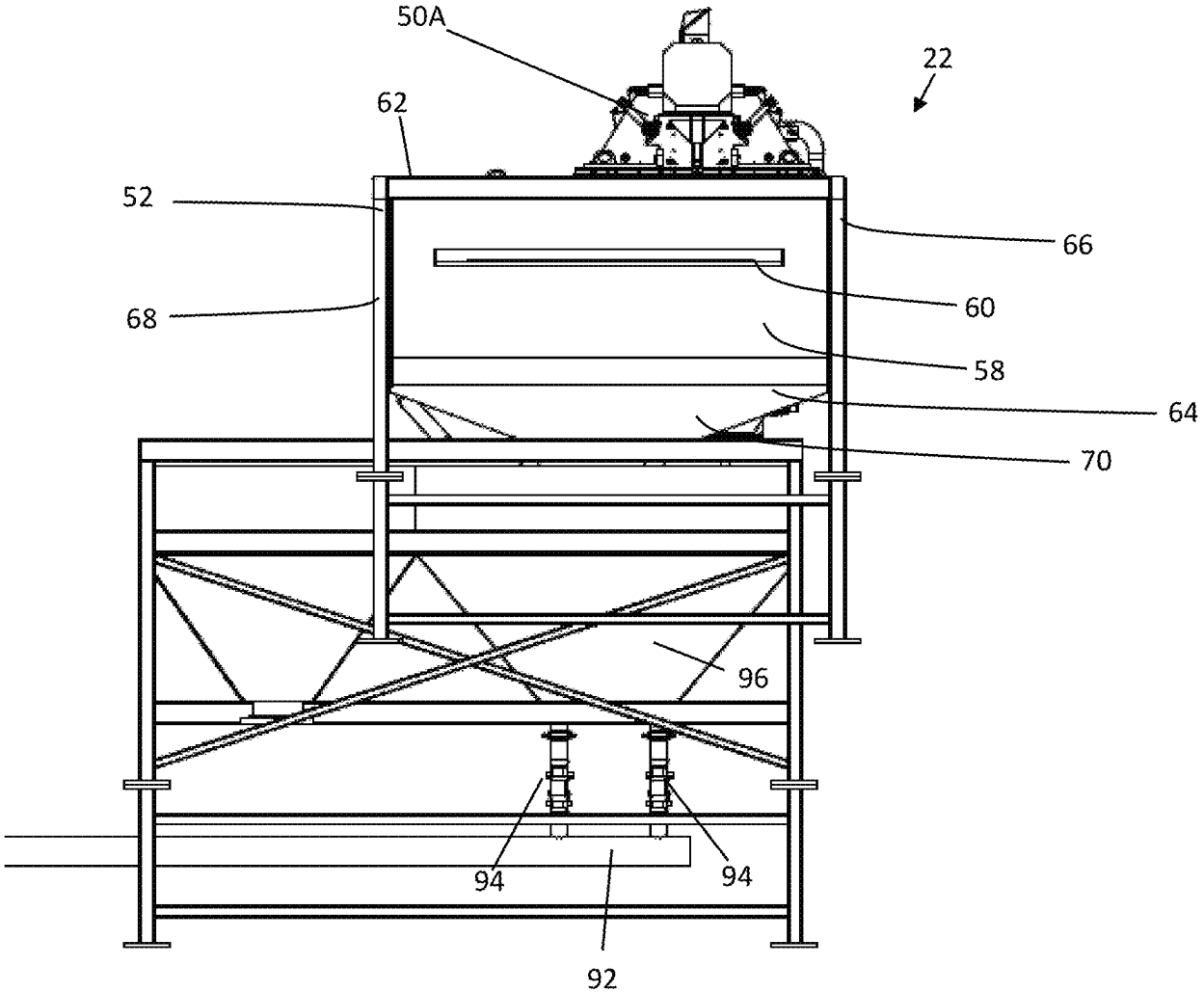
FIG. 8 is a rear end view of a next in sequence descaling component of the processing line.
Figure 9:
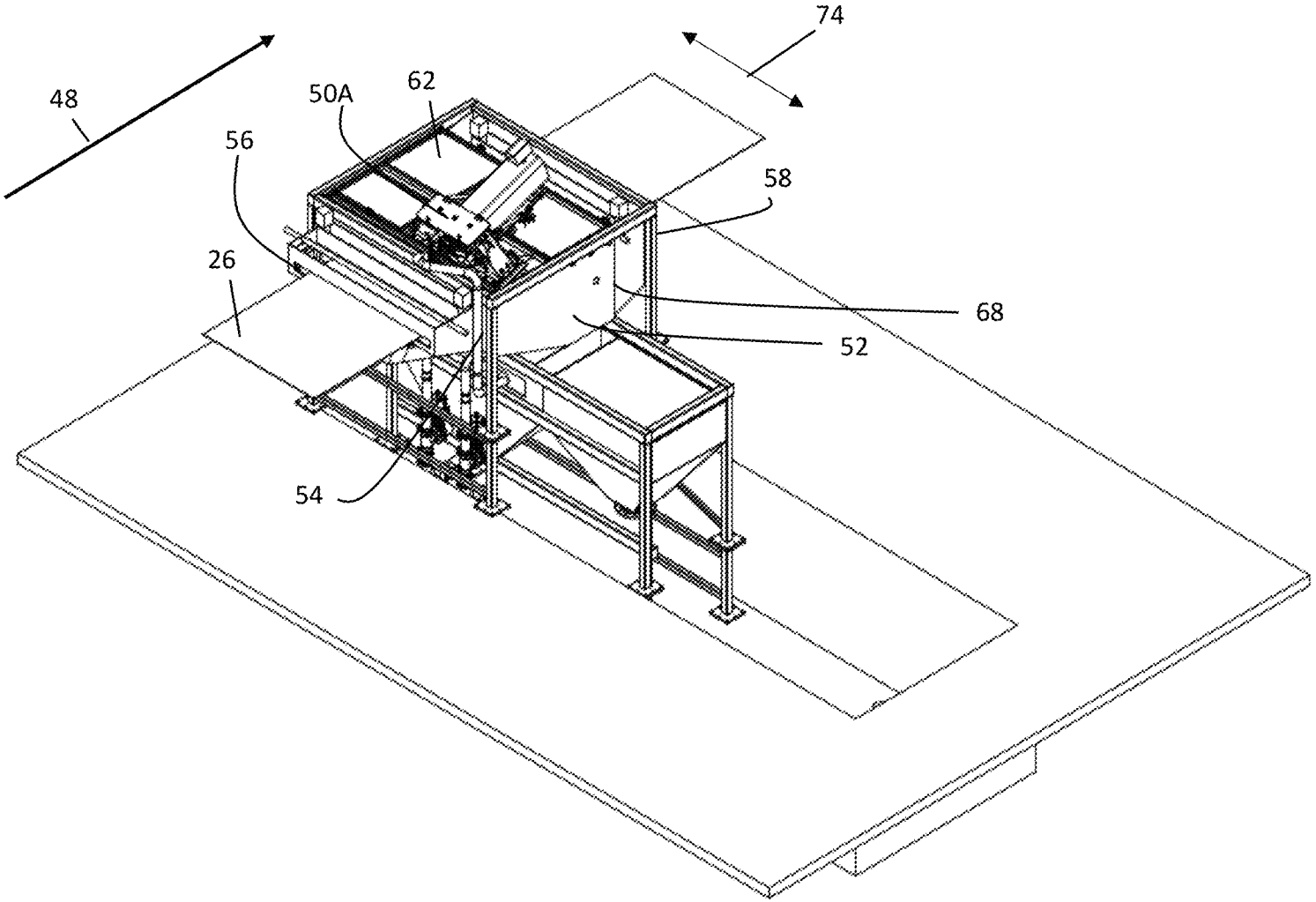
FIG. 9 is a perspective view of the first in sequence descaling component of the processing line showing a floor and a pit of the facility of the processing line.

An upstream or front end 54 (see FIG. 7) of the enclosure has a narrow entrance 56 opening slot to receive the width and thickness of the length of sheet metal 26. An opposite downstream or back end 58 (FIG. 8) of the enclosure has a narrow slot exit opening 60 that is also dimensioned to receive the width and thickness of the length of sheet metal 26. The openings are equipped with sealing devices engineered to contain the slurry within the enclosure or box during the processing of the sheet metal. The descaling component enclosure 52 also has a top 62, a bottom 64, and first and second lateral sides 66,68 that define an interior of the enclosure. The bottom 64 of the enclosure is formed with a discharge chute 70 communicating with the interior of the enclosure. The discharge chute 70 allows the discharge of material removed from the length of sheet metal 26 and the collection of used slurry from the interior of the enclosure 52. As will be explained, in comparison to the descaling components described in applicant's earlier patents, the relative size of the descaling component herein is reduced and accordingly the descaling component no longer includes the retracting support devices used in the prior art descaling component to assist in threading the ends of strips through the machine. Thus, the interior of the enclosure 52 is basically left open except for an optional rinse station (see FIG. 6), which may be provided adjacent to the exit opening 60 of the enclosure.

Each descaling component 22 is provided with a single motor driven slurry propelling impeller 50A mounted on the top 62 of the enclosure 52. Depending upon the location of the descaling component 22 in the processing line, the first in sequence descaling component will have its single top motor driven impeller mounted 50A on the top 62 of the enclosure 52 adjacent one lateral side 66 of the enclosure and the next in sequence descaling component will have its single top motor driven impeller mounted on the top of the enclosure adjacent the opposite lateral side 68 of the enclosure. For example, the first in sequence descaling component will have its single top motor driven impeller 50A mounted on the top 62 of the enclosure 52 on the operator side of the enclosure and the next in sequence descaling component will have its single top motor driven impeller mounted on the top of the enclosure on the drive side of the enclosure. Although not shown in the drawings, the reverse orientation is also possible. Each top motor driven slurry propelling impeller 50A is adapted and configured to propel slurry 72 into the enclosure 52 interior onto a top surface of the sheet metal 26 across an entire width 74 of the sheet metal in a direction extending from one lateral side 66 toward the opposite lateral side 68 of the sheet metal passing through the enclosure interior.

Each descaling component is also provided with a single motor driven slurry propelling impeller 50B mounted on the bottom 64 of the enclosure 52. Depending upon the location of the descaling component in the processing line, the first in sequence descaling component will have its single bottom motor driven impeller 50B mounted on the bottom 64 of the enclosure 52 adjacent one lateral side 66 of the enclosure and the next in sequence descaling component will have its single bottom motor driven impeller 50B mounted on the bottom 64 of the enclosure 52 adjacent the opposite lateral side 68 of the enclosure. For example, the first in sequence descaling component will have its single bottom motor driven impeller 50B mounted on the bottom 64 of the enclosure 52 on the operator side of the enclosure and the next in sequence descaling component will have its single bottom motor driven impeller 50B mounted on the bottom of the enclosure on the drive side of the enclosure. Although not shown in the drawings, the reverse orientation is also possible. The bottom single motor driven slurry propelling impeller 50B is adapted and configured to propel slurry 72 into the enclosure 52 interior onto a bottom surface of the sheet of metal across the entire width 74 of the sheet of metal.

Figure 13:
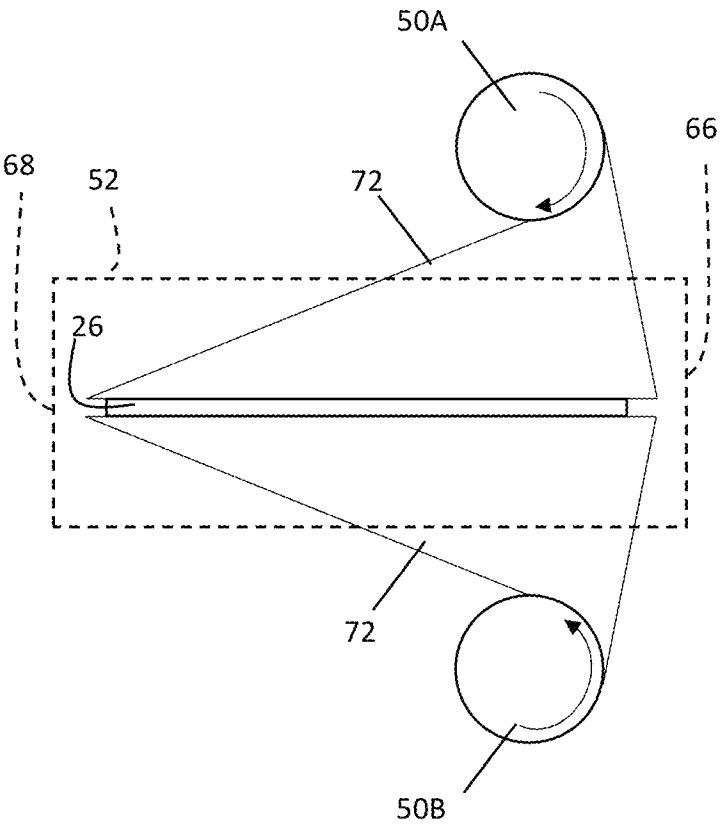
FIG. 13 is a schematic diagram of a blast pattern for the first in sequence descaling component, for instance, as shown in FIG. 5.
Figure 14:
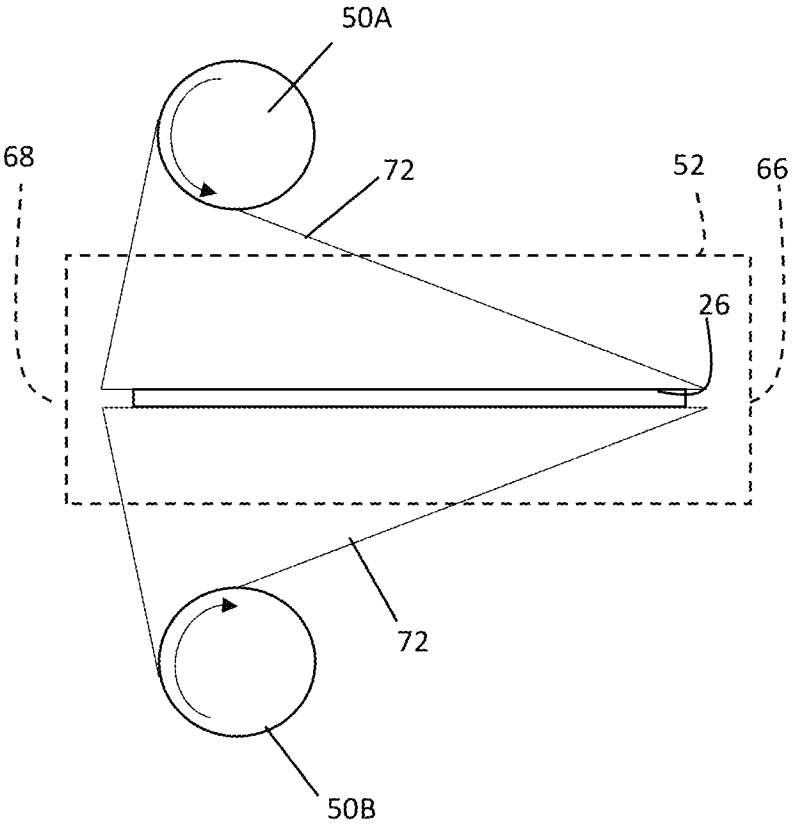
FIG. 14 is a schematic diagram of a blast pattern for the next in sequence descaling component, for instance, as shown in FIG. 5.

For each descaling component 22, the bottom single motor driven slurry propelling impeller 50B may propel slurry 72 into the enclosure interior onto a bottom surface of the sheet of metal 26 across the entire width 74 of the sheet of metal in the same direction as the top single motor driven slurry propelling impeller 50A. For example as shown in FIG. 13, the first in sequence descaling component may be arranged so that both the top and bottom single motor driven impellers 50A,50B propel slurry in a direction extending from the one lateral side 66 of the enclosure toward the opposite lateral side 68 of the enclosure onto sheet metal passing through the enclosure interior, and as shown in FIG. 14, the next in sequence descaling component may be arranged so that both the top and bottom single motor driven impellers 50A,50B propel slurry 72 in a direction extending from the opposite lateral side 68 of the enclosure 52 toward the one lateral side 66 of the enclosure 52 onto the sheet metal passing through the enclosure interior. In this way, the forces exerted by the blast patterns of the top single motor driven slurry propelling impeller 50A and the bottom single motor driven slurry propelling impeller 50B in each descaling component 22 may be balanced across the sheet metal 26 passing through each descaling component.

As between adjacently arranged descaling components 22, the top single motor driven slurry propelling impeller 50A of the first in sequence descaling component is adapted and configured to propel slurry 72 into the enclosure in a direction extending from the first lateral side 66 of the enclosure 52 toward the second lateral side 68 of the enclosure onto the sheet metal 26 passing through the respective enclosure interior, and the top single motor driven slurry propelling impeller 50A of the next in sequence descaling component is adapted and configured to propel slurry 72 into the enclosure in a direction extending from the second lateral side 62 of the enclosure 52 toward the first lateral side 66 of the enclosure onto the sheet metal passing through the respective enclosure interior. In this way, the blast pattern from the top single motor driven slurry propelling impeller 50A of the first in sequence descaling component complements the blast pattern from the top single motor driven slurry propelling impeller of the next in sequence descaling component to cumulatively provide a uniform blast pattern across the entire width 74 of the sheet metal passing through the processing line. In the same way, the bottom single motor driven slurry propelling impeller 50B of the first in sequence descaling component is adapted and configured to propel slurry 72 into the enclosure in a direction extending from the first lateral side 66 of the enclosure 52 toward the second lateral side 68 of the enclosure onto the sheet metal 26 passing through the respective enclosure interior, and the bottom single motor driven slurry propelling impeller 50B of the next in sequence descaling component is adapted and configured to propel slurry 72 into the enclosure in a direction extending from the second lateral side 68 of the enclosure 52 toward the first lateral side 66 of the enclosure onto the sheet metal 26 passing through the respective enclosure interior. In this way, the blast pattern from the bottom single motor driven slurry propelling impeller 50B of the first in sequence descaling component complements the blast pattern from the bottom single motor driven slurry propelling impeller 50B of the next in sequence descaling component to cumulatively provide a uniform blast pattern across the entire width of the sheet metal passing through the processing line.

The impeller wheel 50A,50B of each descaling component is configured such that the contact area of the slurry propelled by each of the descaling wheels extends entirely across, and slightly beyond the width 74 of the length of sheet metal. Allowing the discharge of the impeller wheels to extend slightly beyond the edges of the strip ensures the most uniform coverage. Because the direction of travel of the slurry propelled by impeller wheels relative to the width 74 of the sheet metal direction varies with the discharge position of the slurry across the impeller wheel diameter, there may be some directionality to the resulting texture for positions of slurry impact most distant from the wheel. This may be compensated for by the corresponding (i.e., top or bottom) impeller wheel of the next in sequence descaling component. The corresponding impeller wheel of the next in sequence descaling component may also rotate in a direction opposite to the corresponding impeller wheel of the first in sequence descaling component. The slurry impact density on the processed sheet metal will be greater in areas located closer to the impeller wheel, and gradually across the sheet metal, the density will decrease. Again, aligning an impeller wheel of the first in sequence descaling component on one lateral side of the sheet metal and the corresponding (i.e., top or bottom) impeller wheel of the next in sequence descaling component on the opposite lateral side of the sheet meet, and as applicable rotating the impeller wheels in opposite directions will produce a side-by-side mirror image slurry impact density pattern across the width of the sheet metal thereby providing a uniform blast pattern across the width of the material.

In addition, one or both of the top and bottom single motor driven impellers may be adjustably positioned toward and away from the surface of the sheet metal passing through the descaling component. This provides a secondary adjustment to be used with sheet metal of different widths. By moving the impellers away from the surface of the sheet metal, the widths of the impact areas with the surface of the sheet metal may be increased. By moving the impellers toward the surface of the sheet metal, the widths of the impact areas with the surface of the sheet metal may be decreased. This adjustable positioning of the impellers enables the descaling component to remove scale from different widths of sheet metal. An additional method of width adjustment of the area of slurry impact with the sheet metal surface is to move the angular position of the inlet nozzles relative to the impeller casing/shroud. A third option is to rotate the impeller about an axis normal to the rotational axes relative to the sheet metal travel direction so that the oval area of slurry impact from each wheel, although staying the same length, would not be square or transverse to the sheet metal travel direction. The movement away and toward the strip will also change the impact energy of the flow, and consequently, the effectiveness of the scale removal and surface conditioning for producing rust inhibitive material.

In addition, the angled orientation of the axes of the descaling wheels also causes the impact of the slurry to be directed at an angle relative to the surface of the sheet metal. The angle of the impact of the slurry with the surface of the sheet metal is selected to optimize the effectiveness of the scale removal and surface conditioning for producing rust inhibitive material. An angle of 15 degrees has been proven satisfactory.

Each motor driven slurry propelling impeller 50A,50B is installed in a lined casing, shroud or cowlings which are mounted to a structure of the enclosure of the descaling component, for instance, the enclosure top wall 62 or bottom wall 64 as applicable. The shroud has a hollow interior that communicates through openings in the structure of the enclosure with the interior of the enclosure. An electric motor is provided for each of the top single motor driven slurry propelling impeller 50A and the bottom single motor driven slurry propelling impeller 50B. The respective electric motor is mounted to the shroud and/or respective top 62 and bottom 64 of the enclosure 52. The electric motor has an output shaft that extends through a wall of its associated shroud and into the interior of the shroud. The respective impeller wheel 50A,50B is mounted on the shaft. An elliptically shaped nozzle may be positioned adjacent the injection side of the impeller to control the rate of injection of the slurry into the impeller as is known from applicant's previous patents set forth above. A supply of slurry mixture 72 communicates with the interiors of each of the shroud in the central portion of the impeller and may be injected into the impeller elliptical nozzle at the side of the impeller wheel.

Preferably, the top and bottom impellers operate at a wheel velocity which is relatively lower than wheel velocities using in conventional grit blasting operations. Preferably, the top surface and/or bottom impellers rotate to generate a slurry discharge velocity below 200 feet per second. More preferably, the slurry discharge velocity is in arrange of about 100 feet per second to 200 feet per second. Even more preferably, the slurry discharge velocity is in arrange of about 130 feet per second to 150 feet per second.

Figure 10:
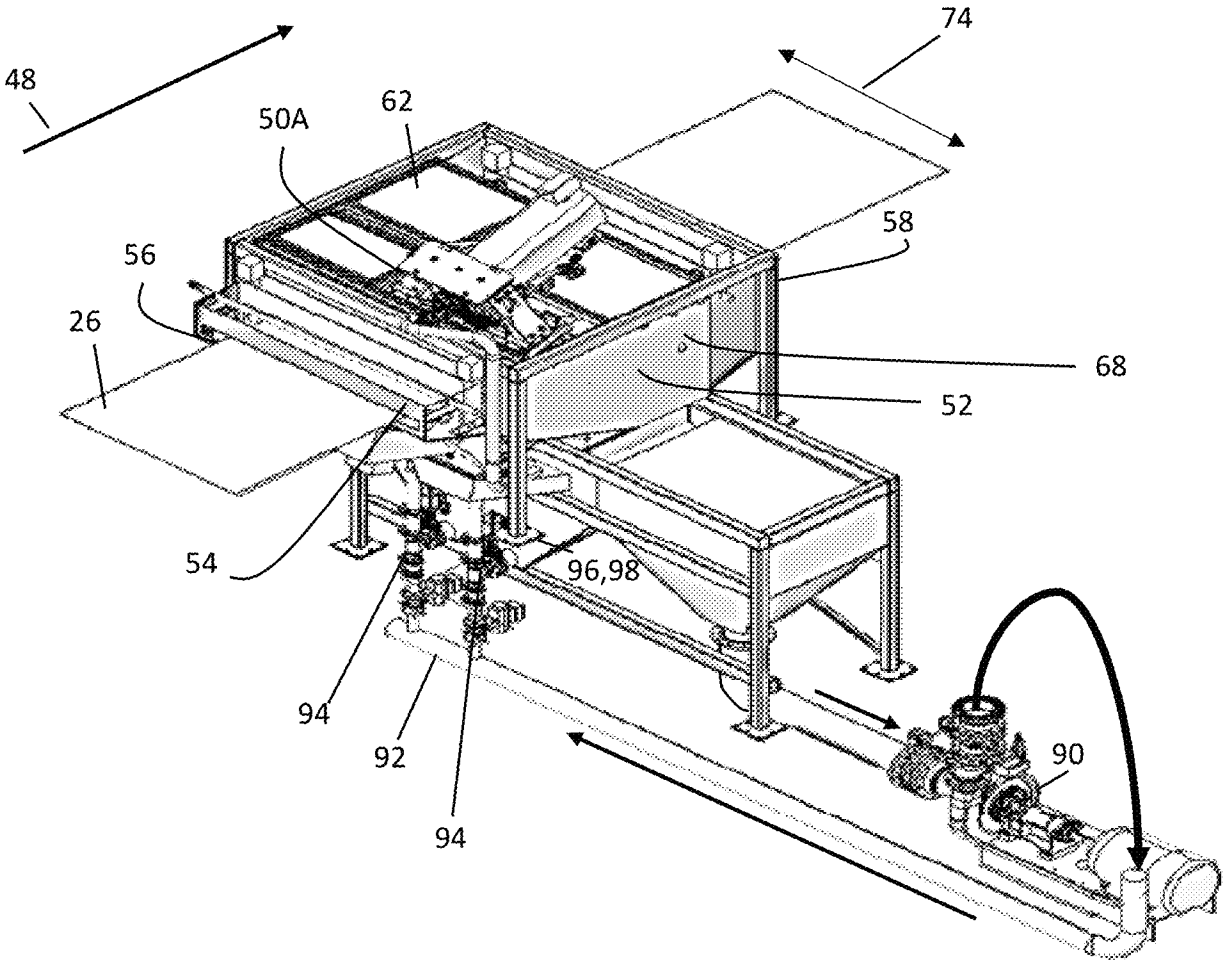
FIG. 10 is a perspective view of the first in sequence descaling component of the processing line showing the floor and the pit of the facility removed to provide further detail of a pump, grit valves and eductors of the descaling component.
Figure 11:
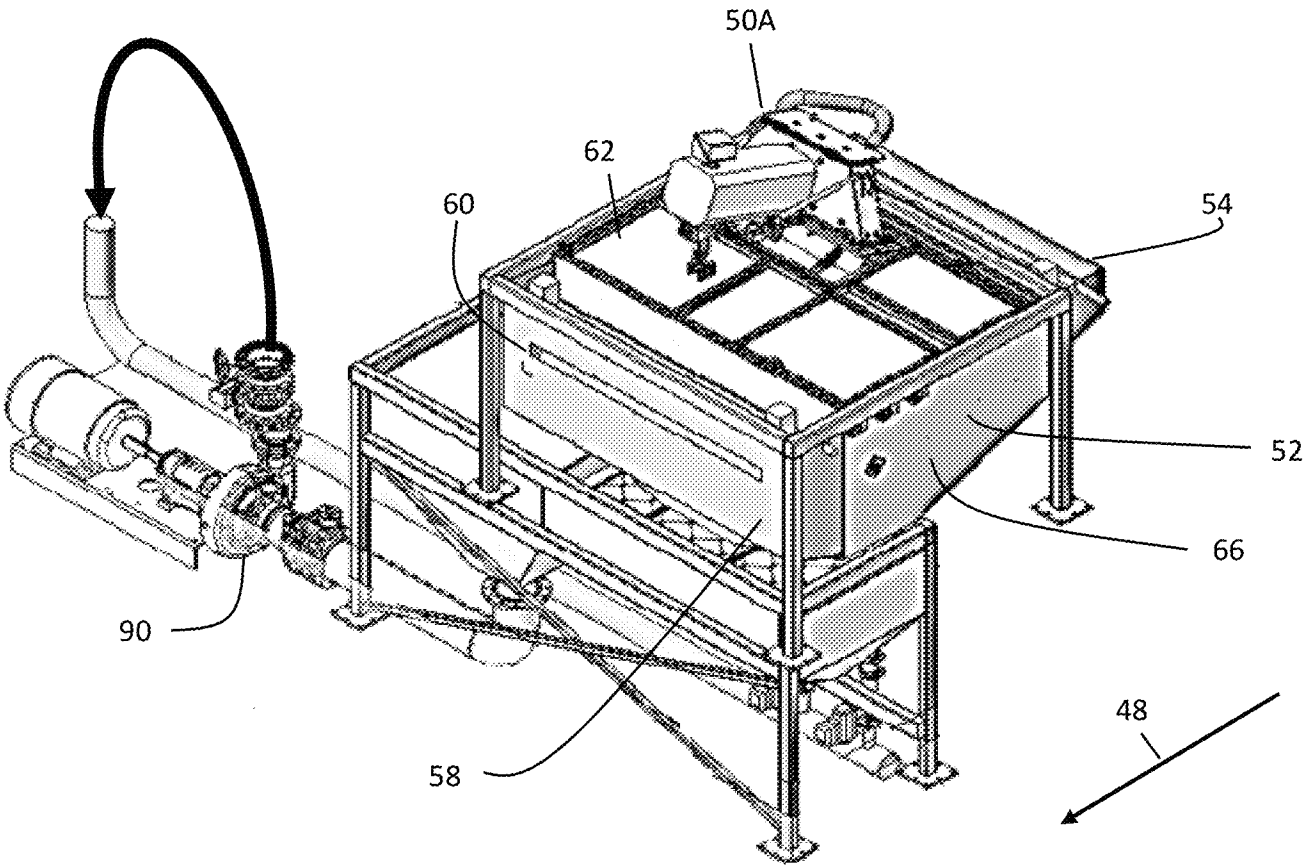
FIG. 11 is a perspective view opposite the view of FIG. 10 showing the first in sequence descaling component of the processing line with the floor and the pit of the facility removed to provide further detail of the pump, the grit valves and the eductors of the descaling component.
Figure 12:
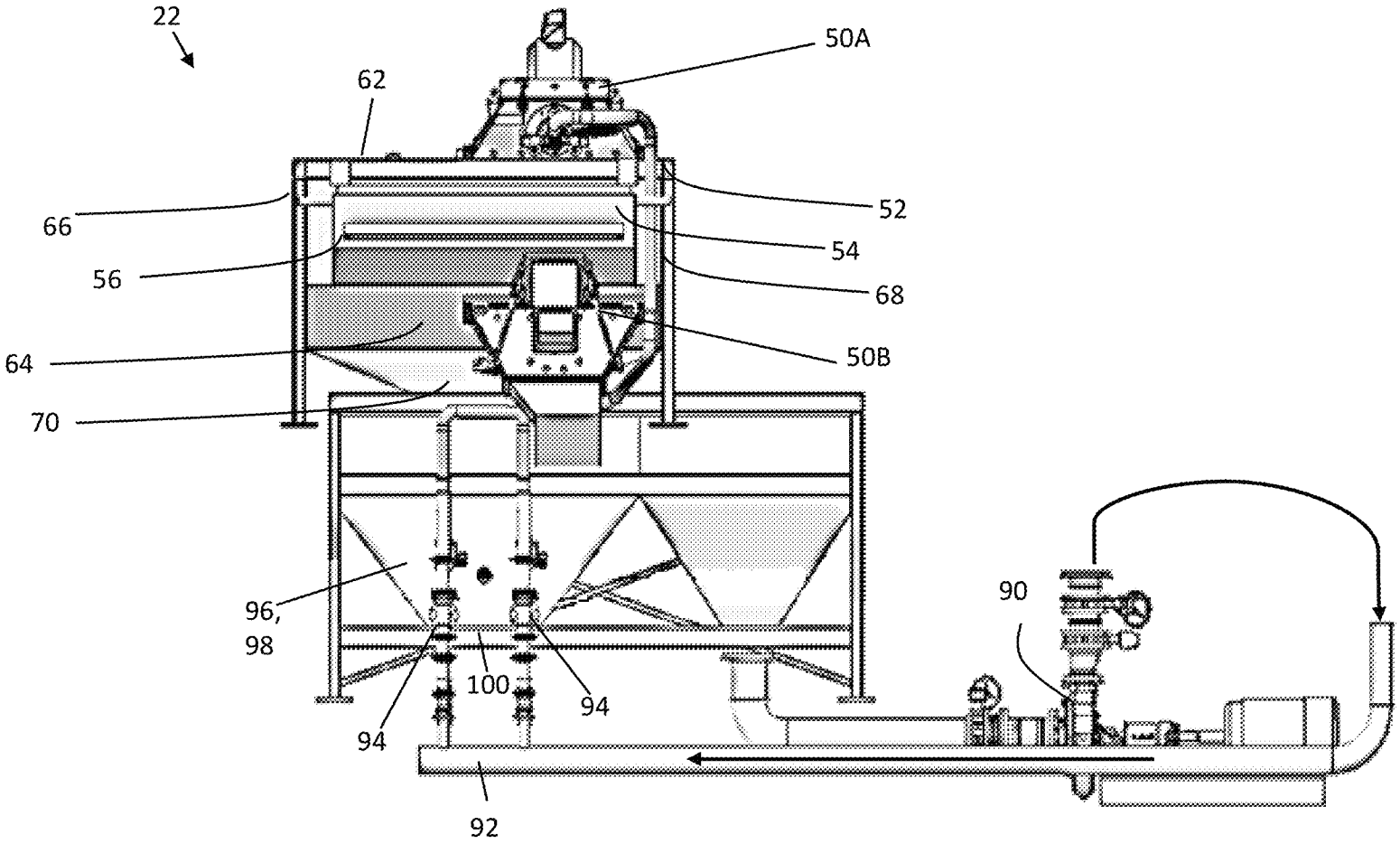
FIG. 12 is a front end view of the first in sequence descaling component of the processing line with the floor and the pit of the facility removed to provide further detail of the pump, the grit valves and the eductors of the descaling component.

In order to generate sufficient slurry flow to the descaling components to remove substantially all of the scale from the surfaces from the sheet metal, it is necessary to generate between at least 1300 pounds per minute of grit flow per blasting wheel. A preferred range is from about 1300 pounds per minute to about 5000 pounds per minute of grit flow per blasting wheel. A grit flow rate of at least 1700 pounds per minute has proven effective. To generate this flow rate, each descaling component includes one primary eductor feed pump 90 (FIGS. 10-12) which generates a flow rate of 1,500 gallons per minute flowing through a 10 inch diameter inlet pipe. The eductor feed pump 90 may have a rating of 200 hp, 1750 rpm, and 150 psi at 1,500 gpm. The eductor feed pump 90 directs its 1,500 per gallon flow rate to a manifold 92 with two outputs, one of which is directed to the inlet of the single top mounted impeller 50A and the other of which is directed to the inlet of the single bottom mounted impeller 50B. The manifold 92 may comprise a 10 inch diameter pipe and with two 3 inch diameter pipe outlets that are further narrowed to accommodate an eductor feed inlet comprising a 2½ inch diameter pipe. An eductor rated for a flow of 425 gallons per minute at 125 psi for a feed liquid temperature of less than 130° F. has been found effective. To prevent fouling of the eductor, the liquid feed is preferably clean, relatively cool (e.g. <130° F.) and free of solid particulate matter.

After passing through an eductor 94, the feed (usually water) is mixed with grit to form the slurry which is directed to the impeller of the respective impeller wheel 50A,50B, as described previously. After impacting the sheet metal in the descaling component, the slurry is collected and directed down the chute 72 to a hindering tank 96. The hindering tank 96 provides a first stage of settling and cleaning of the discharged slurry and allows usable grit to be collected for reuse, and scale and other particulate matter to be further directed to secondary and tertiary settling and cleaning stages as may be necessary, which are not shown. Usable grit from the hindering tank is drawn through an eductor suction line to a respective eductor. By action of the eductor, the grit is combined with the liquid feed in the eductor to form the slurry injected into the impeller wheel of descaling component, as required. Each of the eductor suction lines extending from the hindering tank comprises a 4 inch diameter pipe. The pipe connection may be provided on the front face of the hindering tank. Because there is only one eductor for the top mounted impeller and one eductor for the bottom mounted impeller, the eductors may be arranged on the front face of the hindering tank which simplifies connections in comparison to the prior design with 4 connections on the bottom of the hindering tank and provides other advantages as will be described. In one aspect, the hindering tank may have a trapezoidal cross section with a trapezoidal front face. The eductor 94 for feeding the top mounted impeller 50A and the eductor for feeding the bottom mounted impeller 50B may be provided on the front face 98 of the hindering tank 96 adjacent a lesser (the bottom) base 100 of the trapezoidal shaped front face of the hindering tank. As will be explained, the positioning of the eductors on the front face of the tanks allows for shorter and more direct runs of piping to the inlet of the impellers. Providing a blast wheel diameter of 17½ inches (i.e., blade tip to blade tip diameter) has also been found effective.

While not shown in the drawings, a portion of the effluent from the hindering tank 96 may be recirculated between a cyclonic filtering system and the hindering tank. Another portion of the effluent from the hindering tank 96 may be directed to secondary stage settling and cleaning equipment, comprising a settling tank and filtration unit. The secondary settling tank may have a system of magnetic skimmers and separators to remove metal oxide and other fines from the process. Effluent from the secondary stage settling tank may be directed to the secondary stage filtration system. Effluent from the secondary stage filtration system may then be directed to a cooling tower where the effluent is cooled. The cooled and cleaned liquid may be then directed to the suction side of the eductor feed pumps for further processing in the descaling component. The slurry delivery and recirculation system may comprise multiple stages of settling and cleaning as may be necessary to produce a sufficiently clean motive feed liquid for the slurry.

The type and amount of grit along with the discharge velocity of the slurry 72 mixture are preferably controlled to allow the descaling component to produce a rust inhibitive processed sheet metal with a commercially acceptable surface finish (i.e., roughness). Controlling the type and amount of grit along with the discharge velocity of the slurry 72 mixture reduces the probability of scale or grit particles being imbedded into the softer steel surface of the processed sheet metal. A relatively low wheel velocity for propelling the slurry and an angular grit has been found efficient in removing the scale oxide layers from the processed sheet metal strip and producing rust inhibitive properties for the processed sheet metal. By propelling the slurry 72 at velocities below 200 feet per second, the angular grit will not fracture to a significant extent, and will gradually become rounded in configuration as it is spent through repeated impact with the processed steel sheet. The rounding of the grit that occurs in the descaling process results in some of the grit becoming smaller in size. A blend of grit sizes assists in ensuring more uniform surface coverage of the processed sheet metal.

With the foregoing in mind, forming the slurry mixture from water and a steel grit having a size range of SAE G80 to SAE G40 has proven effective. Forming the slurry mixture from water and a steel grit having a size of SAE G50 has also proven effective. To ensure the efficacy of the slurry mixture, the grit to water ratio is preferably monitored and controlled. A grit-to-water ratio of about 2 pounds to about 15 pounds of grit for each gallon of water has proven effective. A grit-to-water ratio of about 4 pounds to about 10 pounds of grit for each gallon of water has also proven effective. The grit to water ratio may be controlled in a slurry recirculation system of the descaling component 22 and may use the eductors 94, valves, and the pump 90 to meter the concentration of grit and liquid.

Each descaling component 22 may be provided with one or more rinse stations. An entrance rinse station 104 may be provided in the interior of the enclosure 52 adjacent to the entrance opening 56 adjacent the front end 54 of the enclosure. The entrance rinse station 104 may comprise one or more bars extending from one lateral side of the enclosure to the opposite lateral side of the enclosure. The bar of the entrance rinse station 104 may be provided with jets arranged to direct rinse agent onto the surface of the sheet metal 26 in a perpendicular direction relative to surface of the sheet metal. Although only a top entrance rinse station is shown, the descaling component may be provided with a similar configure bottom entrance rinse station. A blind rinse station 106 may also be provided in the interior of the enclosure 52 after in the direction of the movement 48 of the sheet metal the slurry impact zone of the top impeller 50A of the descaling component. The blind rinse station 106 may comprise one or more bars extending from one lateral side of the enclosure to the opposite lateral side of the enclosure. The bar of the blind rinse station 106 may be provided with jets arranged to direct rinse agent onto the surface of the sheet metal 26 at an acute angle relative to the surface of the sheet metal across the entire width of the sheet of metal. Depending upon the direction of the slurry being propelled from the top impeller 50A of the descaling component (i.e., from the operator side (e.g., a first lateral side) to the drive side (e.g., a second lateral side), or vice versa), the jets of the bar of the blind rinse station 106 may be arranged to propel rinse agent in the same direction so that the momentum from the slurry blast and the impact from the rinse jets facilitates removal of slurry and grit from the top surface of the metal sheet in the enclosure. As will be explained, it is generally not necessary to provide a blind rinse station for propelling a rinse agent onto the bottom surface of the sheet of metal. An exit rinse station 108 may be provided in the interior of the enclosure 52 adjacent to the exit opening 60 adjacent the back end 58 of the enclosure. The exit rinse station 108 may comprise one or more bars extending from one lateral side of the enclosure to the opposite lateral side of the enclosure. The bar of the exit rinse station 108 may be provided with jets arranged to direct rinse agent onto the surface of the sheet metal 26 in a perpendicular direction relative to surface of the sheet metal. Although only a top exit rinse station is shown, the descaling component may be provided with a similarly configured bottom exit rinse station. The action of the rinse stations 104, 106, 108, and particularly, the blind rinse station 108, may reduce the phenomenon of blinding described below.

To assist in control of the processing line, an in-line detector may be used to detect a surface condition of the top and/or bottom surfaces of the processed sheet metal after passing through the descaling components, and an output of the in-line detector may be used to assist the processing line operator in adjusting any one or more of the following to obtain a desired surface condition: (i) pivoting, rotating, angling, and/or positioning the top surface impeller wheel(s) of the first descaling component; (ii) pivoting, rotating, angling, and/or positioning the bottom surface impeller wheel(s) of the first descaling component; (iii) pivoting, rotating, angling, and/or positioning the top surface impeller wheel(s) of the second descaling component, (iv) pivoting, rotating, angling, and/or positioning the bottom surface impeller wheel(s) of the second descaling component, or (v) increasing or decreasing the processing line speed. The in-line detector may be positioned after the next in sequence descaling component. For example, the detector may comprise an oxide detector positioned downstream in the processing line after the two descaling components and adapted to detect the level of scale remaining on both the top and bottom surfaces of the strip, and based at least in part upon a detected surface condition (i.e., the level of scale detected), adjustments may be made to the first and/or second descaling component operation (i.e., impeller wheel speed, impeller wheel angles, impeller wheel position), or processing line speed (i.e., a rate of sheet metal advancement through the descaling component). The detector may also be a surface finish detector, i.e., a profilometer, and the surface condition to be detected and controlled may correspond to surface finish. The detector may also comprise a machine vision system, and the surface condition to be detected and controlled may correspond to surface flaws in the processed sheet, for instance, blemishes, slivers, residue, metallic smut, an agglomeration of loose scale, wear debris, etc. One or more detectors may be used to detect a surface condition of the top surface and bottom surface of the sheet metal. A combination of surface conditions may be detected, and the operating parameters of each of the descaling component may be varied to attain the surface condition(s) desired.

In another embodiment of the descaling component, the detector may be provided with an automatic feedback mechanism that allows for automatic control of processing line operating parameters based at least in part of the detected surface condition. For instance, based upon the detected surface condition, the rate of slurry impact may be controlled to produce a specific surface condition, for instance, a surface finish less than about 100 Ra. The rate of slurry impact may be varied by varying the discharge velocity of the propelled slurry or by varying the processing line speed, i.e., the speed at which the sheet steel is advanced through the line. Thus, based at least in part of the detected surface condition, a rate of advancement of the sheet material through the descaling component may be changed as desired. In addition to or in the alternative, a discharge rate of slurry being propelled against the side of the sheet metal may be varied as necessary based at least in part upon the detected surface condition. For a system involving centrifugal impellers, the impeller wheel velocity may be changed based at least in part of the detected surface condition. Generally speaking, to obtain a desired surface condition, any one or more of the following may be changed based at least in part upon the detected surface condition: (i) pivoting, rotating, angling, and/or positioning the top surface impeller wheel(s) of the first descaling component; (ii) pivoting, rotating, angling, and/or positioning the bottom surface impeller wheel(s) of the first descaling component; (iii) pivoting, rotating, angling, and/or positioning the top surface impeller wheel(s) of the second descaling component, (iv) pivoting, rotating, angling, and/or positioning the bottom surface impeller wheel(s) of the second descaling component, or (v) increasing or decreasing the processing line speed. One or more detectors may be used to detect a surface condition of the top surface and bottom surface of the sheet metal, and a top surface detected surface condition and/or a bottom surface detected surface condition may provide input to the automated processing line control system.

The applicant has determined that there are significant advantages in reducing the number of impeller wheels in each descaling component from 4 top mounted impellers and 4 bottom mounted impellers to 1 top mounted impeller and 1 bottom mounted impeller. In particular, the applicant has found unexpectedly that the arrangement of a descaling cell with 1 top mounted impeller and 1 bottom mounted impeller allows for the arrangement of a rinse station in the enclosure that more effectively rinses the strip without causing interference of rinse spray pattern with the slurry blast pattern from the top mounted impeller, and that the phenomena of blinding found in the prior art systems can be effectively eliminated. Blinding occurs when the grit is not adequately removed from the strip. When blinding occurs, the downstream impeller slurry blast pattern becomes less efficient because of slurry and grit remaining on the sheet metal. In other words, the blast pattern of the downstream impeller is impeded by the slurry and grit remaining on the metal sheet. Blinding is less of a concern on the bottom surface of the sheet, because the slurry and grit falls off the surface of the metal sheet due to gravity. However, in the prior art descaling cell design with 4 impellers (2 per each descaling component) aimed at the top surface of the sheet metal, blinding may occur for 3 of the 4 impellers even with a rinse station provided in the descaling cell. While the conventional systems use rinse stations to remove slurry and grit from the sheet, there are competing constraints in the conventional systems due to the limitations on the size of the enclosure structure and the area of the blast patterns generated by the numerous impellers and the rinse stations. Enlarging the structure of the enclosure to accommodate more rinse stations for each of the impellers is undesirable. Within the existing confines of the enclosure, increasing the number or rinse stations or the spray patterns of the rinse stations is also undesirable as the increased rinse stations and/or rinse spray patterns would interfere with the slurry blast patterns and prevent satisfactory scale removal. Adding more rinse stations in the conventional systems would effectively limit space available in the enclosure for slurry to impact the sheet metal.

Providing one descaling component with 1 top mounted impeller and an adjacent second descaling component with an oppositely arranged 1 top mounted impeller allows for more advantageous arrangement of a rinse station to remove slurry and grit from the sheet and eliminate blinding. The elimination of blinding has been found whether the rinse station is arranged as a blind rinse directed at angles in a direction from the center of the sheet metal outward toward the lateral sides of the sheet metal (e.g. bi-directional blind rinses), or blind rinses directed at an acute angle toward the sheet metal in the same direction as the impeller blast pattern.

As to blind rinses directed at an acute angle toward the sheet metal in the same direction as the impeller blast pattern, it has been found that this arrangement can particularly advantageous for eliminating blinding in certain applications. It has been found that in certain applications, after impact with the slurry, the sheet metal can be more effectively rinsed in a descaling component where the single top mounted impeller is aimed in one direction and is coupled with a rinse station with jets (e.g. the blind rinse station 108) aimed in the same direction to more effectively sweep slurry and grit off the surface of the metal sheet. Lateral side to side directional rinse cannot be provided in the prior art descaling cell design with 4 impellers (2 per each descaling component) due to the fact that the volume of slurry generated by the impellers would create undesirable imbalance in the discharge of the enclosures and flowrates through the eductors, and otherwise undesirably lengthen the enclosures to accommodate the rinse stations between the impeller wheels.

Also, in the current design, the single impeller on the top and bottom of the enclosure allows the enclosure to be smaller in length and overall size in contrast to the prior art design which include 2 impellers mounted on the top of the enclosure and 2 impellers mounted on the bottom of the enclosure. The smaller footprint enclosure is much easier to manufacture, more amenable to fabrication with standard fabrication equipment, and simpler to package as a component in standard sized shipping containers to reduce freight costs. Further, a descaling component with the smaller footprint enclosure may be used as either the first in sequence descaling component or the next in sequence descaling component merely by changing the lateral position of the impeller and motor. Thus, the decaling component herein may be a more standard item for manufacture in comparison to the descaling component with 2 impellers mounted on the top of the enclosure and 2 impellers mounted on the bottom of the enclosure. Thus, the smaller footprint of the descaling component with the single top and bottom impeller mounted on the enclosure reduces space and reduces facility installation costs. While both designs requires the use of pits at the facility to accommodate the discharge chute, tanks, pumps, piping, valves and eductors, the conventional design requires that the pits are 20 feet deep, while the reduced footprint and size of the exemplary descaling cell requires pits that are about 6½ feet deep. Also, the exemplary descaling cell uses less energy per ton of sheet metal processed in contrast to the prior system with 2 impellers mounted on the top of the enclosure and 2 impellers mounted on the bottom of the enclosure.

The smaller footprint of the enclosure also allows for the elimination of mechanical components that allow threading of the sheet metal through the entrance and exit openings of the enclosure. The prior art descaling component with 2 top mounted impellers and 2 bottom mounted impellers is significantly longer. So, to thread the head of a coil through the first descaling component and the second descaling component, each descaling component is provided with a series of thread arms and thread fingers that deploy downward in the enclosure to help support the coil head as it travels through the descaling component. When the coil head is clamped in the recoiler at the end of the processing line, the thread arms and thread fingers can return to the up position in the enclosure. However, for a time during threading operations, the components are deployed downward position and subject to blast from the impellers. As a consequence, the components experience significant wear. The descaling component with the single top and bottom mounted impeller is shorter in length. Accordingly, during threading operations, the coil head may supported on rollers located between the first in sequence and next in sequence descaling components. Thus, the thread arms and thread fingers are not needed as the coil head may be more easily threaded through the first in sequence and next in sequence descaling components. The elimination of the thread arms and thread fingers reduces overall maintenance costs with the processing line as the thread arms and thread fingers are high maintenance components.

Applicant has also found that a descaling component with a single top motor driven impeller, allows for more efficient flow of grit and slurry from the eductors located at the hindering tank to the single top motor driven impeller. The smaller footprint of the enclosure of the descaling component allows for shorter and more direct runs of pipe for supplying slurry to the top single motor driven impeller. As a consequence, the motor for the top impeller uses less energy in comparison to the motors of the prior art design with 2 top mounted impellers. Further, because the footprint of the enclosure is smaller, the hindering tank may be arranged to allow the eductors to be mounted on the front faces of the hindering tanks rather than at the bottom of the hindering tanks. This also allows for shorter and more direct runs of pipe for supplying slurry to the top single motor driven impeller.

Although the apparatus and the method of the invention have been described herein by referring to several embodiments of the invention, it should be understood that variations and modifications could be made to the basic concept of the invention without departing from the intended scope of the following claims.

What is claimed is:

1. A method for descaling a sheet of metal comprising:

providing a first component for a slurry blasting descaling cell, wherein the first component comprises an enclosure with an interior, the enclosure having a top and a bottom, first and second lateral sides, and front and back sides, the front side having an entrance opening into the interior, the back side having an exit opening into the interior, the front and back sides being transverse to the lateral sides, the enclosure having only one motor driven slurry propelling impeller mounted on the top of the enclosure and only one motor driven slurry propelling impeller mounted on the bottom of the enclosure;

providing a second component for a slurry blasting descaling cell, wherein the second component comprises an enclosure with an interior, the enclosure having a top and a bottom, first and second lateral sides, and front and back sides, the front side having an entrance opening into the interior, the back side having an exit opening into the interior, the front and back sides being transverse to the lateral sides, the enclosure having only one motor driven slurry propelling impeller mounted on the top of the enclosure and only one motor driven slurry propelling impeller on the bottom of the enclosure;

on the first component, positioning the only one motor driven slurry propelling impeller mounted on the top of the enclosure and the only one motor driven slurry propelling impeller mounted on the bottom of the enclosure so that each motor driven slurry propelling impeller propels slurry into the enclosure interior onto respective top and bottom surfaces of the sheet of metal across an entire width of the sheet of metal in a first direction from the first lateral side toward the second lateral side when the sheet of metal passes through the interior of the first component;

on the second component, positioning the only one motor driven slurry propelling impeller mounted on the top of the enclosure and the only one motor driven slurry propelling impeller mounted on the bottom of the enclosure so that each motor driven slurry propelling impeller propels slurry into the enclosure interior onto respective top and bottom surfaces of the sheet of metal across an entire width of the sheet of metal in a second direction from the second lateral side toward the first lateral side when the sheet of metal passes through the interior of the second component;

forming the slurry blasting descaling cell by positioning the first component relative to the second component such that their respective first lateral sides are aligned on one side of the slurry blasting descaling cell and their respective second lateral sides are aligned on an opposite side of the slurry blasting descaling cell, and such that the sheet of metal to be processed in the descaling cell passes through the entrance opening of the front side of the first component, passes through the interior of the first component, passes through the exit opening of the back side of the first component, passes through the entrance opening of the front side of the second component, passes through the interior of the second component, and passes through the exit opening of the back side of the second component;

aiming jets of a rinse station in the first component enclosure to propel a rinse agent onto the top surface of the sheet of metal across the entire width of the sheet of metal in the first direction when the sheet of metal passes through the enclosure interior of the first component; and aiming jets of a rinse station in the second component enclosure to propel rinse agent onto the top surface of the sheet of metal across the entire width of the sheet of metal in the second direction when the sheet of metal passes through the enclosure interior of the second component.

2. The method of claim 1 further comprising:

providing a hindering tank for the first component, the hindering tank having a front and a back, the front of the hindering tank corresponding to the front of the first component; and at a pipe connection on the front of hindering tank front, connecting an eductor that supplies slurry to the only one motor driven slurry propelling impeller mounted on the top of the first component.

3. The method of claim 2 further comprising:

at a further pipe connection on the front of hindering tank front, connecting a further eductor that supplies slurry to the only one motor driven slurry propelling impeller mounted on the bottom of the first component.

4. The method of claim 3 wherein the step of providing the first component with the hindering tank front comprises providing the hindering tank with a trapezoidally shaped face with the eductor pipe connections adjacent a lesser base of the trapezoidally shaped face.

5. The method of claim 1 further comprising:

providing a hindering tank for the second component, the hindering tank having a front and a back, the front of the hindering tank corresponding to the front of the second component; and at a pipe connection on the front of hindering tank front, connecting an eductor that supplies slurry to the only one motor driven slurry propelling impeller mounted on the top of the second component.

6. The method of claim 5 further comprising:

at a further pipe connection on the front of hindering tank front, connecting a further eductor that supplies slurry to the only one motor driven impeller mounted on the bottom of the second component.

7. The method of claim 6 wherein the step of providing the second component with the hindering tank front comprises providing the hindering tank with a trapezoidally shaped face with the eductor pipe connections adjacent a lesser base of the trapezoidally shaped face.

8. The method of claim 1 further comprising:

advancing the sheet of metal through the descaling cell by advancing the sheet of metal through the entrance opening of the front side of the first component, through the interior of the first component, through the exit opening of the back side of the first component, through the entrance opening of the front side of the second component, through the interior of the second component, and through the exit opening of the back side of the second component.

9. The method of claim 8 further comprising:

with the only one motor driven slurry propelling impeller mounted on the top of the enclosure of the first and second components, propelling slurry across the entire width the sheet metal to substantially remove all of the scale on the top surface of the sheet of metal;

with the only one motor driven slurry propelling impeller mounted on the bottom of the enclosure of the first and second components, propelling slurry across the entire width the sheet metal to substantially remove all of the scale on the bottom surface of the sheet of metal.

* * * * *